US006767238B2

(12) United States Patent
Kitadai

(10) Patent No.: US 6,767,238 B2
(45) Date of Patent: Jul. 27, 2004

(54) CONNECTOR UNIT, ELECTRONIC APPARATUS SYSTEM PROVIDED WITH THE SAME, ELECTRONIC APPARATUS PROVIDED WITH CONNECTOR, AND MAIN APPARATUS PROVIDED WITH CONNECTOR

(75) Inventor: Takashi Kitadai, Hamura (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/233,403

(22) Filed: Sep. 4, 2002

(65) Prior Publication Data

US 2003/0104730 A1 Jun. 5, 2003

(30) Foreign Application Priority Data

Nov. 30, 2001 (JP) ..... 2001-367827

(51) Int. Cl.[7] ..... H01R 13/64
(52) U.S. Cl. ..... 439/378; 439/680
(58) Field of Search ..... 439/680, 681, 439/378

(56) References Cited

U.S. PATENT DOCUMENTS 5,466,171 A * 11/1995 Bixler et al. ..... 439/378
5,885,088 A * 3/1999 Brennan et al. ..... 439/680

FOREIGN PATENT DOCUMENTS

| | | |
|---|---|---|
| JP | 4-45077 | 10/1992 |
| JP | 6-155974 | 6/1994 |
| JP | 8-315910 | 11/1996 |
| JP | 2563707 | 11/1997 |
| JP | 11-26076 | 1/1999 |
| JP | 11-97107 | 4/1999 |
| JP | 2001-102115 | 4/2001 |
| JP | 2001-210407 | 8/2001 |

* cited by examiner

*Primary Examiner*—Hung V. Ngo
(74) *Attorney, Agent, or Firm*—Pillsbury Winthrop LLP

(57) ABSTRACT

A first connector includes a connector body having a first connecting surface and a number of connecting holes opening in the first connecting surface and having connecting terminals therein. The connector body has first and second engaging holes that open in the first connecting surface on the opposite sides of the array of connecting holes, individually. A connector body of a second connector has a second connecting surface with a width and a length substantially equal to those of the first connecting surface, a number of terminal pins protruding from the second connecting surface, and first and second guide protrusions protruding from the second connecting surface, located on the opposite end sides of the array of terminal pins, and adapted to be inserted into the first and second engaging holes, respectively. The guide protrusions project higher than the terminal pins and have different sectional shapes.

14 Claims, 8 Drawing Sheets

CONNECTOR UNIT, ELECTRONIC APPARATUS SYSTEM PROVIDED WITH THE SAME, ELECTRONIC APPARATUS PROVIDED WITH CONNECTOR, AND MAIN APPARATUS PROVIDED WITH CONNECTOR

CROSS-REFERENCE TO RELATED APPLICATIONS

This application is based upon and claims the benefit of priority from the prior Japanese Patent Application No. 2001-367827, filed Nov. 30, 2001, the entire contents of which are incorporated herein by reference.

BACKGROUND OF THE INVENTION

1. Field of the Invention

The present invention relates to a connector unit, an electronic apparatus system provided with the same, a main apparatus provided with a connector, and an electronic apparatus provided with a connector.

2. Description of the Related Art

Modern electronic apparatuses such as personal computers use various card-type electronic apparatuses as expansion features or memories, for example. One such card-type electronic apparatus usually comprises a connector that is attached to the distal end portion of a card-shaped body. As this connector is connected to a connector on the personal-computer side, it is set in and connected electrically to the personal computer.

According to an electronic apparatus described in Jpn. Pat. Appln. KOKAI Publication No. 6-155974, for example, a connector on the apparatus body side to which an IC memory card is connected is provided with a connector body from which protrude a large number of terminal pins. The connector body has a guide portion that guides the IC memory card to be connected. The guide portion is designed to guide the opposite side faces and upper and lower surfaces of the insertion-side portion of the memory card. Thus, the connector body including the guide portion has a thickness and a width greater than those of the IC memory card.

A connecting device described in Jpn. UM Appln. KOKOKU Publication No. 4-45077 is provided with a connector body from which protrude a large number of connecting pins. The connector body integrally has a guide portion that guides a card to be connected. The connector body including the guide portion has a width greater than the width of the card and is designed to guide the opposite side faces on the insertion side of the card.

Modern electronic apparatuses such as personal computers are expected to be further miniaturized. According to the electronic apparatus and connecting device constructed in the aforesaid manner, however, the connector body on the apparatus body side includes the guide portion that guides or supports the insertion-end portion of the card, and is larger than the card in size. Thus, the connector on the apparatus body side is so much larger than a card-shaped electronic apparatus that is very thin and compact that it may possibly constitute a hindrance to the miniaturization of the whole main computer.

BRIEF SUMMARY OF THE INVENTION

The present invention has been contrived in consideration of these circumstances, and its object is to provide a connector unit capable of miniaturization and reliable connection, an electronic apparatus system provided with the same, an apparatus body provided with a connector, and an electronic apparatus provided with a connector.

In order to achieve the above object, a connector unit according to an aspect of the invention comprises a first connector and a second connector connected to the first connector.

The first connector includes a first connector body having an elongated first connecting surface with a given width, a large number of connecting holes formed in the first connector body to open in the first connecting surface, having connecting terminals therein, and arranged in the longitudinal direction of the first connecting surface, and first and second engaging holes formed in the first connector body and opening in the first connecting surface on the opposite end sides of the array of connecting holes, individually.

The second connector includes a second connector body having a second connecting surface with a width and a length substantially equal to those of the first connecting surface, a large number of terminal pins fixed to the second connector body, protruding from the second connecting surface, and arranged on the second connecting surface corresponding to the connecting holes of the first connector, and first and second guide protrusions protruding from the second connecting surface, located on the opposite end sides of the array of terminal pins, and configured to be inserted into the first and second engaging holes, respectively, to guide the first and second connectors in connection into cooperation with the first and second engaging holes.

The first and second guide protrusions project higher than the terminal pins and have different cross sectional shapes. The first engaging hole has a sectional shape corresponding to that of the first guide protrusion, and can allow insertion of the first guide protrusion and restrain insertion of the second guide protrusion. The second engaging hole has a sectional shape corresponding to that of the second guide protrusion, and can allow insertion of the second guide protrusion and restrain insertion of the first guide protrusion.

An electronic apparatus system according to another aspect of the invention comprises an electronic apparatus having a first connector and a main apparatus having a second connector to which the first connector is connected.

The first connector includes a first connector body provided on an end portion of the electronic apparatus and having an elongated first connecting surface with a given width, a large number of connecting holes formed in the first connector body, having connecting terminals therein, and arranged in the longitudinal direction of the first connecting surface, and first and second engaging holes formed in the first connector body and opening in the first connecting surface on the opposite end sides of the array of connecting holes, individually.

The second connector includes a second connector body having a second connecting surface with a width and a length substantially equal to those of the first connecting surface, a large number of terminal pins fixed to the second connector body, protruding from the second connecting surface, and arranged on the second connecting surface corresponding to the connecting holes of the first connector, and first and second guide protrusions protruding from the second connecting surface, located on the opposite end sides of the array of terminal pins, and adapted to be inserted into the first and second engaging holes, respectively, to guide the first and second connectors in connection in cooperation with the first and second engaging holes.

The first and second guide protrusions project higher than the terminal pins and have different sectional shapes. The first engaging hole has a cross sectional shape corresponding to that of the first guide protrusion, and can allow insertion of the first guide protrusion and restrain insertion of the second guide protrusion. The second engaging hole has a cross sectional shape corresponding to that of the second guide protrusion, and can allow insertion of the second guide protrusion and restrain insertion of the first guide protrusion.

An electronic apparatus according to still another aspect of the invention comprises a body and a plug-in connector provided on an end portion of the body and connected to a station connector of a main apparatus. The plug-in connector includes a connector body having an elongated connecting surface with a given width, a large number of connecting holes formed in the connector body so as to be arranged in the longitudinal direction of the connecting surface, having connecting terminals therein, and adapted to be penetrated individually by terminal pins, and first and second engaging holes formed in the connector body, opening in the connecting surface on the opposite sides of the array of connecting holes, individually, and adapted be penetrated individually by guide protrusions of the station connector, the first and second engaging holes having different cross sectional shapes.

A main apparatus according to a further aspect of the invention comprises a mount portion in which an electronic apparatus having a plug-in connector is set and a station connector located adjacent to the mount portion and connected with the plug-in connector. The station connector includes a connector body having an elongated connecting surface with a given width, a large number of terminal pins fixed to the connector body, protruding from the connecting surface, and arranged on the connecting surface corresponding to connecting holes of the plug-in connector, and first and second guide protrusions protruding from the connecting surface, located on the opposite end sides of the array of terminal pins, and adapted to be inserted individually into engaging holes of the plug-in connector to guide the plug-in connector and the station connector into connection, the first and second guide protrusions projecting higher than the terminal pins and having different cross sectional shapes.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate an embodiment of the invention, and together with the general description given above and the detailed description of the embodiment given below, serve to explain the principles of the invention.

DETAILED DESCRIPTION OF THE INVENTION

Figure 1:
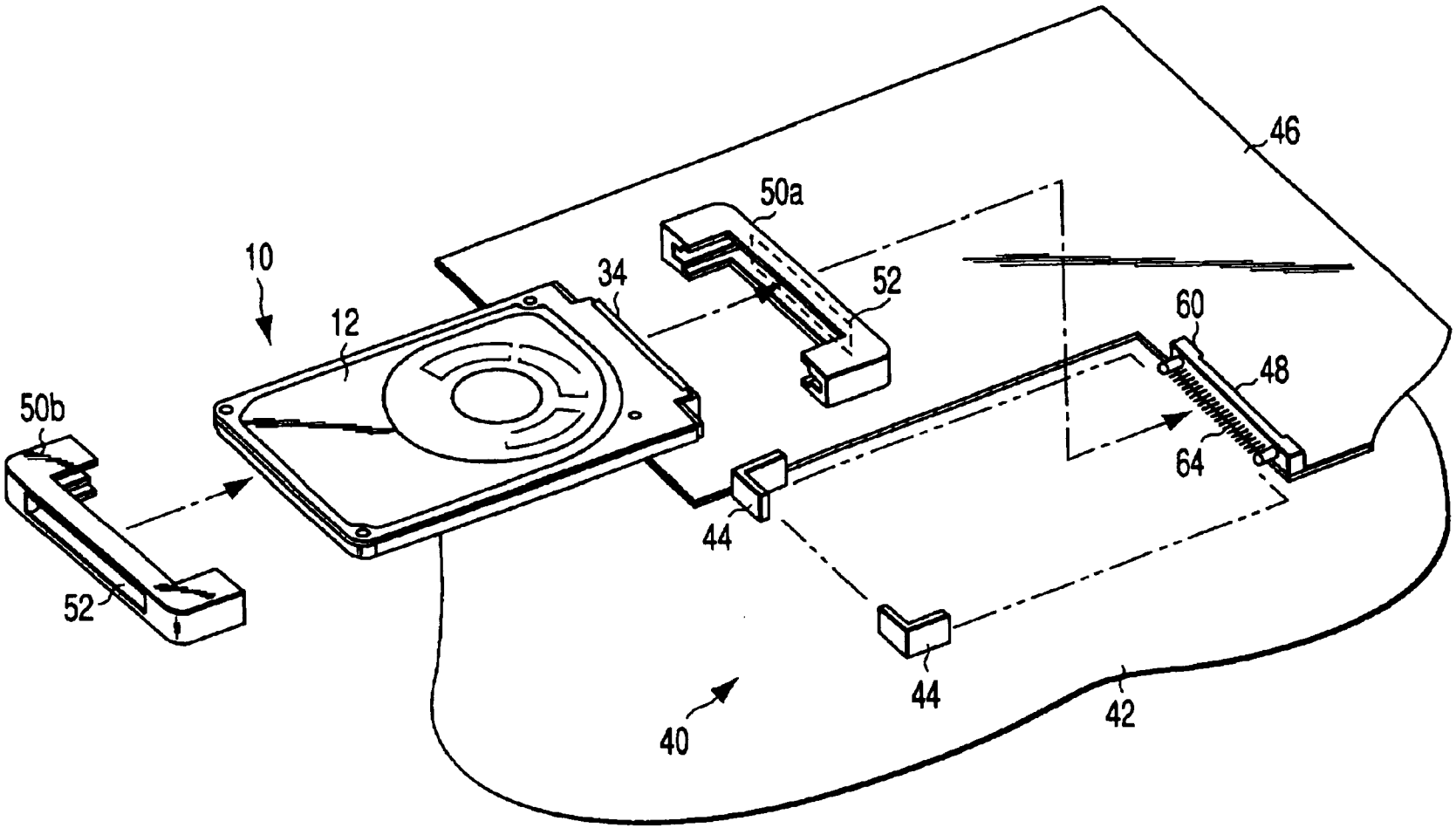
FIG. 1 is an exploded perspective view showing an electronic apparatus system according to an embodiment of the invention.
Figure 2:
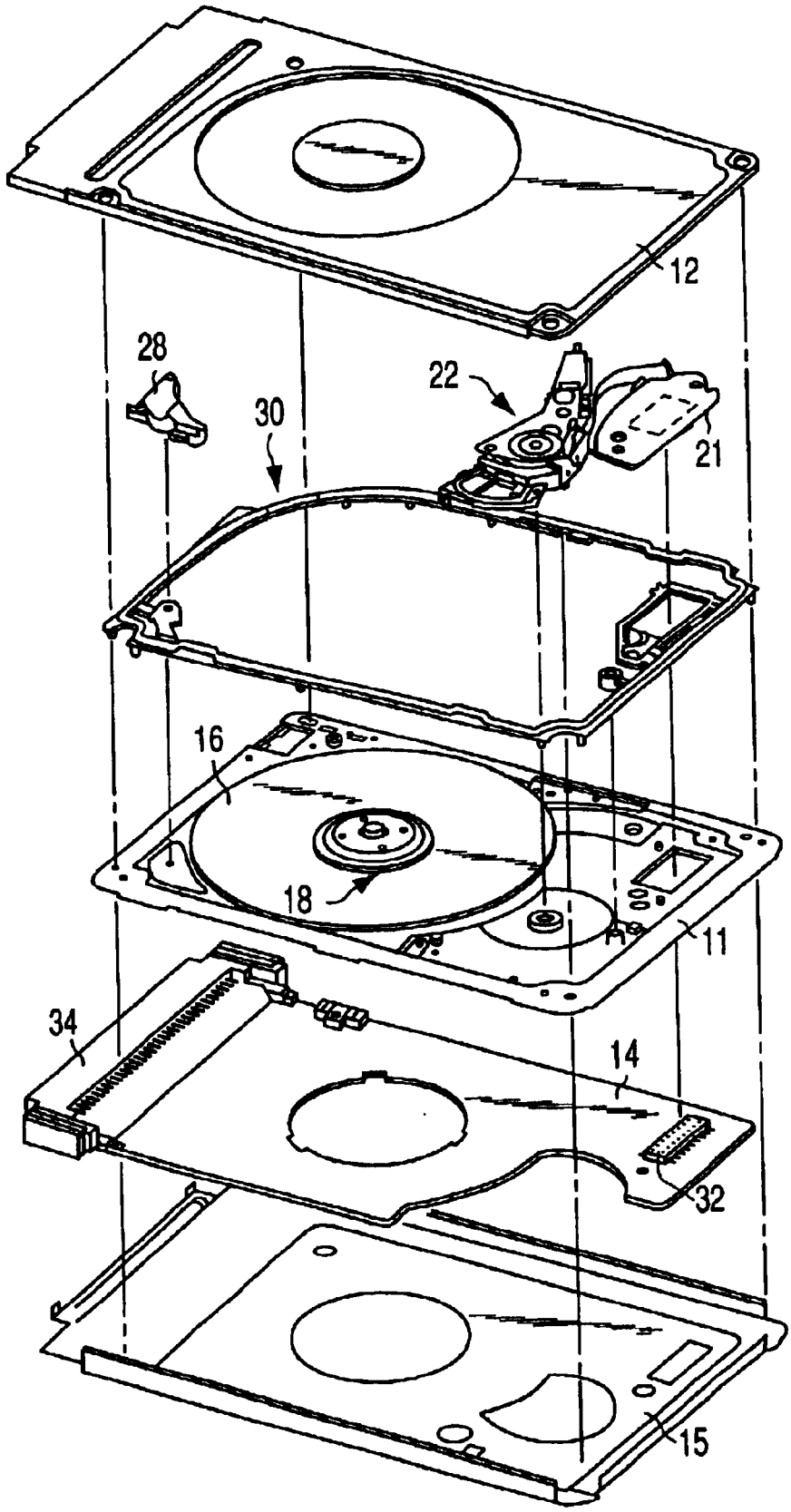
FIG. 2 is an exploded perspective view showing an HDD in the electronic apparatus system.
Figure 3:
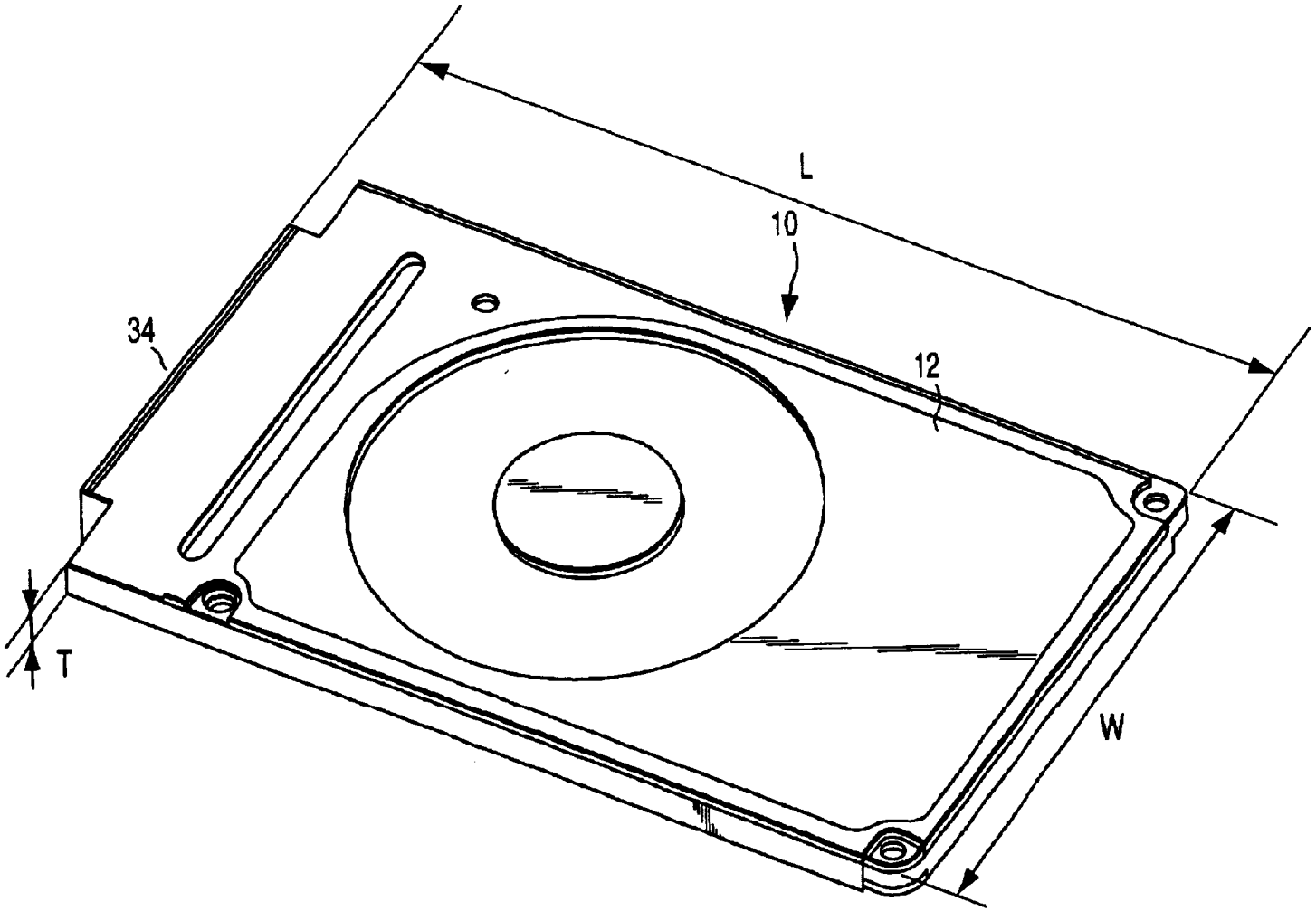
FIG. 3 is a perspective view of the HDD.

A card-shaped electronic apparatus and a personal computer capable of being loaded with the same will now be described as an electronic apparatus system according to an embodiment of the present invention with reference to the accompanying drawings.

First, a magnetic disc apparatus, e.g., a hard disc drive (hereinafter referred to as an HDD), will be described as the card-shaped electronic apparatus. As shown in FIGS. 1 to 4, an HDD 10 is in the form of a flat, substantially rectangular card having a thickness T of 5.0 mm, width W of 54 mm, and length L of 78.5 mm. The HDD 10 comprises a metallic base 11 in the form of a rectangular plate, a plate-shaped top cover 12 that overspreads the upper surface of the base 11, a printed circuit board 14 on the bottom side of the base, and a bottom cover 15 that overspreads the bottom side of the base. All these elements are stacked in layers to form a card-shaped body as a whole. A frame-shaped seal 30 is provided between the base 11 and the top cover 12. The seal 30 serves to keep the space inside the base 11 airtight.

The base 11 carries thereon a 1.8-inch magnetic disc 16 that serves as an information recording medium, a spindle motor 18 as a drive motor for supporting and rotating the magnetic disc, and a plurality of magnetic heads for writing information to and reading it from the magnetic disc, and a head actuator 22 that supports the magnetic heads for movement with respect to the magnetic disc 16. The base 11 further carries thereon a voice coil motor (not shown) for rocking and positioning the head actuator 22, a ramped loading mechanism, an inertia latch mechanism, a circuit board unit 21 including a head IC and the like, an air filter 28, etc.

The printed circuit board 14 is mounted with a connector 32 connected to the circuit board unit 21 and a plug-in connector 34 for connecting the HDD 10 to the personal computer. The plug-in connector 34, which serves as a first connector, projects from the front end of the HDD 10.

Figure 4:
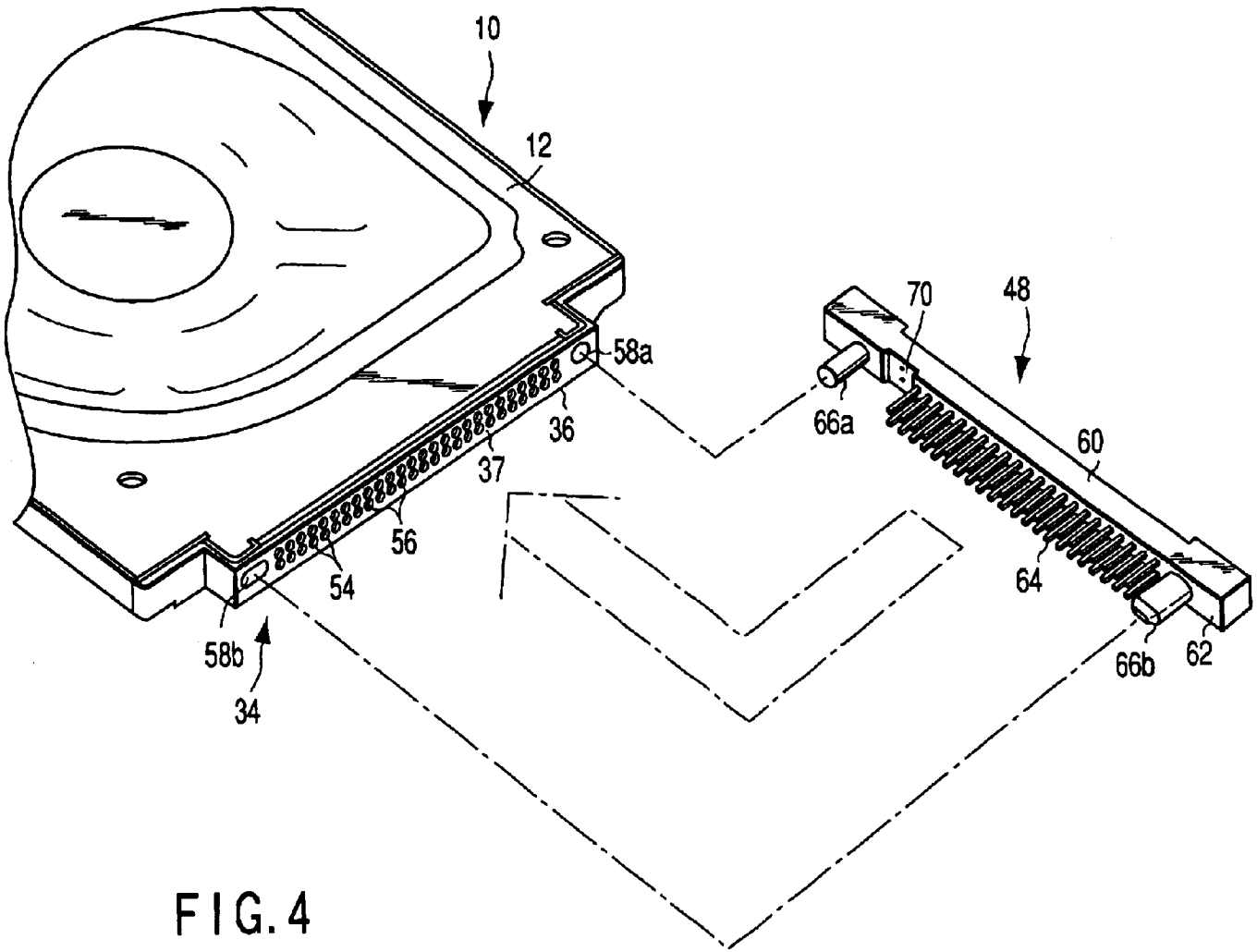
FIG. 4 is an exploded perspective view showing a plug-in connector of the HDD and a station connector of a main apparatus.

As shown in FIGS. 1 and 4, the personal computer for use as a main apparatus has a mounting structure for setting and holding the HDD 10 with the aforementioned construction. More specifically, the personal computer comprises a mount portion 40 in a part of its casing. The mount portion 40 has a flat mount surface 42. A pair of L-shaped positioning projections 44 protrudes from the mount surface 42. The positioning projections 44 are arranged so as to position two rear corners of the HDD 10.

A main printed circuit board (hereinafter referred to as a main PCB) 46 is located in the casing of the personal computer and adjacently opposed to the mount surface 42. The main PCB 46 is mounted with a station connector 48 to which the plug-in connector 34 of the HDD 10 is to be connected, and which is opposed to the mount portion 40. The station connector 48 serves as a second connector of the present invention.

The mounting structure is provided with first and second cushioning members 50*a* and 50*b* that are removably attached to the peripheral edge portion of the HDD 10. The first and second cushioning members 50*a* and 50*b* are formed of an elastic material such as rubber. Each cushioning member is thicker than the HDD 10, especially, the thickest portion of the HDD.

The cushioning members 50*a* and 50*b* have the same shape. Each cushioning member is substantially U-shaped, corresponding to the shape of each longitudinal-direction end portion of the HDD 10. More specifically, the cushioning members 50*a* and 50*b* are formed so that they can be attached individually to the longitudinal-direction end portions of the HDD 10 from outside, thereby covering the end portions and the corners of the HDD, individually.

Further, each of the first and second cushioning members 50*a* and 50*b* has an opening 52 that corresponds to the connector 34 of the HDD 10. Thus, the first cushioning member 50*a* can be attached to one end portion of the HDD 10 with the connector 34 exposed in the opening 52.

Figure 5A:
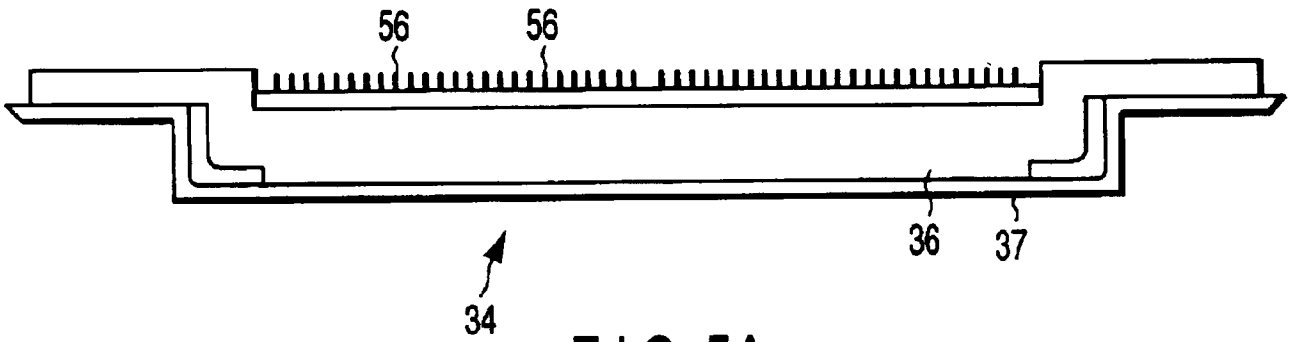
FIGS. 5A and 5B are a plan view and a front view, respectively, showing the plug-in connector.
Figure 5B:
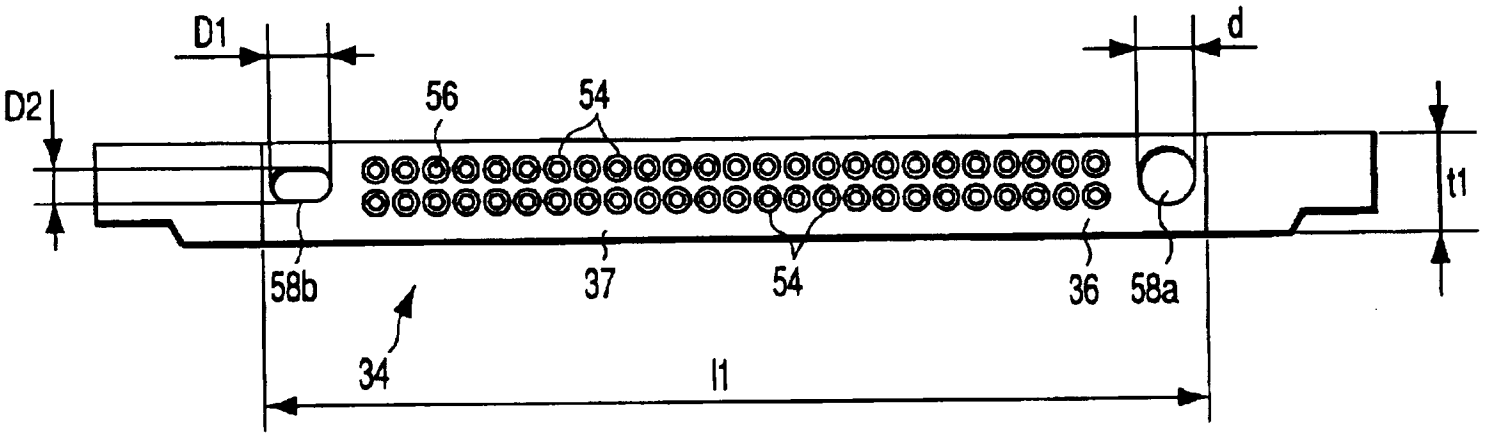
Figure 6A:
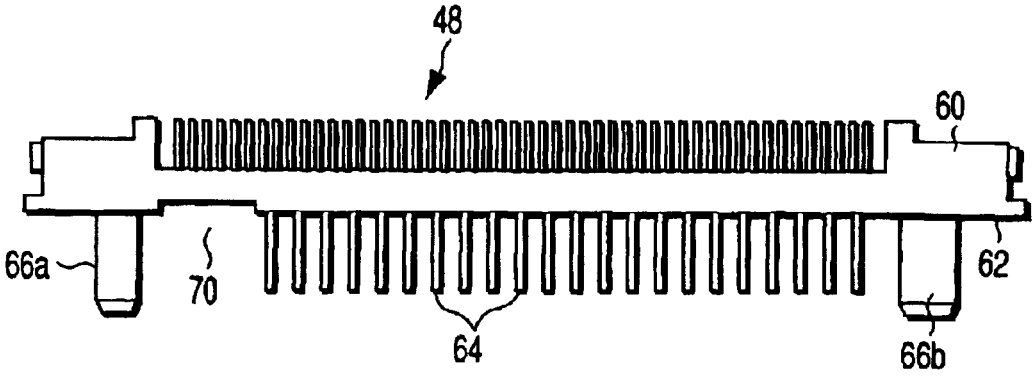
FIGS. 6A and 6B are a plan view and a front view, respectively, showing the station connector.
Figure 6B:
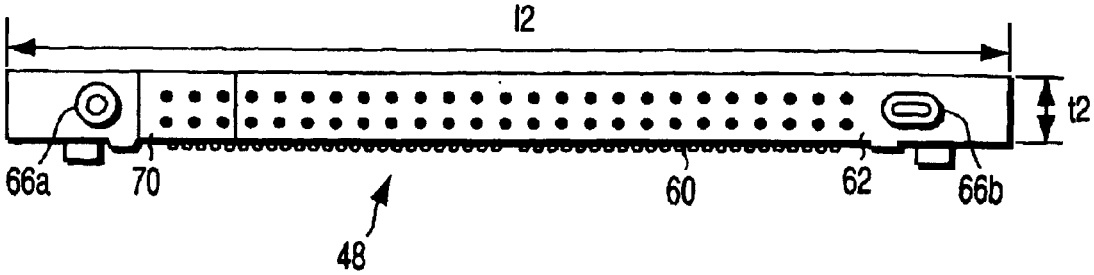

As shown in FIGS. 4, 5A and 5B, the plug-in connector 34 of the HDD 10 has an elongated connector body 36 of resin. The connector body 36 is fixed to the front end portion of the HDD 10 and extends substantially covering the overall width of the HDD.

The connector body 36 has a strip-shaped connecting surface 37 that is exposed to the front end of the HDD 10. The connecting surface 37 has a width t1 a little less than the thickness T of the HDD 10 and a length 11 a little less than the width W of the HDD 10, and extends in the width direction of the HDD.

The connector body 36 is formed having a large number of connecting holes 54, which open in the connecting surface 37 and extend substantially at right angles to the connecting surface. The connecting holes 54 are arranged in two rows and at given pitches in the lengthwise direction of the connecting surface 37. Connecting terminals 56 are located in the connecting holes 54, individually.

Further, the connector body 36 is formed having first and second engaging holes 58*a* and 58*b*, which open in the connecting surface 37 on the opposite sides of the array of connecting holes 54. The first and second engaging holes 58*a* and 58*b* extend substantially at right angles to the connecting surface 37. The engaging holes 58*a* and 58*b* have different cross sectional shapes. More specifically, the first engaging hole 58*a* has a circular cross section, and its diameter d is sufficiently greater than the diameter of each connecting hole 54. The second engaging hole 58*b* has a substantially elliptical cross section. The major axis D1 of the elliptical cross section of the second engaging hole 58*b* is greater than the diameter d of the first engaging hole 58*a*, and the minor axis D2 of the ellipse is less than the diameter d of the first engaging hole.

As shown in FIGS. 1, 4, 6A and 6B, the station connector 48 of the personal computer to which the plug-in connector 34 of the HDD 10 is connected has an elongated connector body 60 of resin. The connector body 60 has a width and a length substantially equal to those of the connecting surface 37 of the plug-in connector 34 of the HDD 10. In other words, the connector body 60 has a width t2 less than the thickness T of the HDD 10 and a length 12 less than the width W of the HDD.

That surface of the connector body 60 which faces the mount portion 40 of the personal computer forms a stripe-shaped connecting surface 62. A large number of terminal pins 64 are fixed to the connector body 60 and extend substantially perpendicularly from the connecting surface 62. The terminal pins 64 are arranged in two rows and at the same given pitches as the connecting holes 54 of the plug-in connector 34 in the lengthwise direction of the connecting surface 62.

The connector body 60 is formed integrally with first and second guide pins 66*a* and 66*b*, which are situated on the opposite sides of the array of terminal pins 64. The first and second guide pins 66*a* and 66*b*, which serve as guide protrusions, individually, protrude substantially perpendicularly from the connecting surface 62 and have a height of projection greater than that of the terminal pins 64.

Further, the first and second guide pins 66*a* and 66*b* have different cross sectional shapes that correspond to those of the first and second engaging holes 58*a* and 58*b* of the plug-in connector 34, respectively. Thus, the guide pins 66*a* and 66*b* can be fitted in the engaging holes 58*a* and 58*b*, respectively.

More specifically, the first guide pin 66*a* has a circular cross section, and its diameter is substantially equal to the diameter d of the first engaging hole 58*a*. The second guide pin 66*b* has a substantially elliptical cross section. The major and minor axes of the elliptical cross section of the second guide pin 66*b* are substantially equal to the major and minor axes D1 and D2 of the ellipse of the second engaging hole 58*b*. The major axis is greater than the diameter of the first guide pin 66*a*, and the minor axis is less than the diameter of the first guide pin.

In connecting the plug-in connector 34 of the HDD 10 to the station connector 48 of the personal computer, the first and second guide pins 66*a* and 66*b* are inserted into their corresponding first and second engaging holes 58*a* and 58*b* of the plug-in connector 34, whereupon the guide pins are fitted substantially entirely to the engaging holes. Thus, the first and second guide pins 66*a* and 66*b* can guide the plug-in connector 34 and the station connector 48 in being connected to each other, and restrain the HDD 10 from shifting its position in a direction perpendicular to the direction of connection after the connection, thereby keeping the HDD from being dislocated with respect to the station connector 48.

Since the first and second engaging holes 58*a* and 58*b* and the first and second guide pins 66*a* and 66*b* have the aforementioned shapes and dimensions, the first guide pin 66*a* can engage only the first engaging hole 58*a*, while the second guide pin 66*b* can engage only the second engaging hole 58*b*. If the HDD 10 is inverted when its connection to the station connector 48 is attempted, the first engaging hole 58*a* restrains the insertion of the second guide pin 66*b*, and at the same time, the second engaging hole 58*b* restrains the insertion of the first guide pin 66*a*. Thus, the first and second engaging holes 58*a* and 58*b* and the first and second guide pins 66*a* and 66*b* can prevent the HDD 10 from being connected inverted to the station connector 48.

As shown in FIGS. 4 and 6, the connecting surface 62 of the station connector 48 is formed having a recess 70 between the first guide pin 66*a* and the terminal pins 64, into which a jumper pin can retreat.

Figure 7:
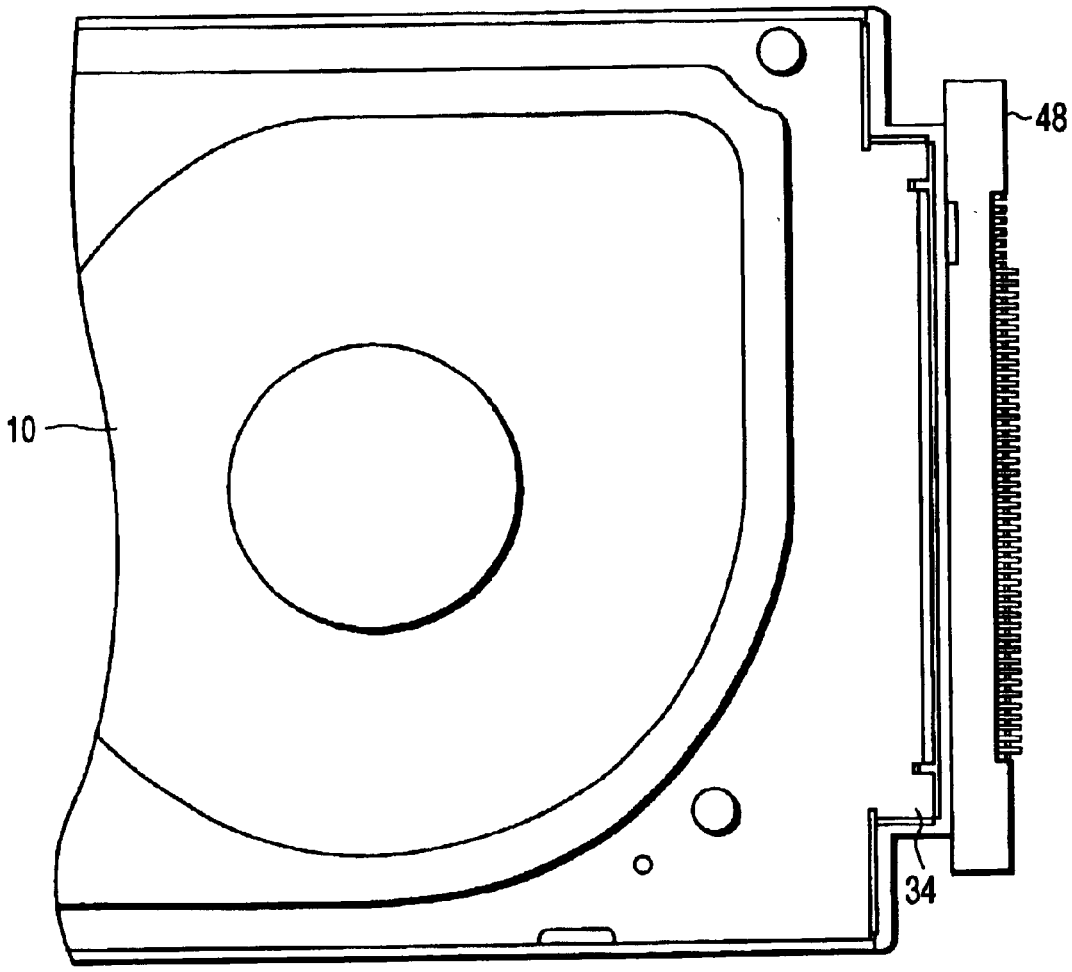
FIG. 7 is a plan view showing the plug-in connector of the HDD and the station connector connected to each other.

In loading the HDD 10 into the personal computer, as shown in FIGS. 1, 4 and 7, the first and second cushioning members 50*a* and 50*b* are first attached to the longitudinally opposite end portions of the HDD 10. Then, the HDD 10 is placed on the mount surface 42 of the mount portion 40 in a manner such that it is aligned with the positioning projections 44, and at the same time, the plug-in connector 34 is connected to the station connector 48 through the opening 52 of the first cushioning member 50*a*. If the HDD 10 is then set in a right direction, the first and second guide pins 66*a* and 66*b* are first brought into contact with the plug-in connector 34 and then inserted into the first and second engaging holes 58*a* and 58*b*, respectively. As the connecting operation is continued using the guide pins 66*a* and 66*b* and the engaging holes 58*a* and 58*b* as guide means, the plug-in connector 34 and the station connector 48 are positioned with respect to each other. Thereupon, the terminal pins 64 of the station connector 48 are inserted individually into the connecting holes 54 of the plug-in connector 34 to be connected electrically to the connecting terminals 56. Thus, the HDD 10 is located in a predetermined position with respect to the mount portion 40, and is connected electrically to the main PCB 46 through the plug-in connector 34 and the station connector 48.

According to the electronic apparatus system constructed in this manner, the station connector 48 of the personal computer is provided with the first and second guide pins 66*a* and 66*b* that extend integrally from the connecting surface 62 of the connector body 60. As the guide pins 66*a* and 66*b* are inserted and fitted into their corresponding first and second engaging holes 58*a* and 58*b* of the plug-in connector 34 of the HDD 10, the connectors are guided in connection, and the connected HDD 10 is held in position. Accordingly, the station connector 48 can be miniaturized to match the thin HDD 10, so that the installation space for the station connector 48 can be reduced, and the whole personal computer can be reduced in size.

Further, the first and second guide pins 66*a* and 66*b* are located on the opposite sides of the array of terminal pins 64, and project further than the terminal pins. In the connecting operation, therefore, the first and second guide pins 66*a* and 66*b* engage the plug-in connector 34 in advance of the terminal pins 64. Thus, the possibility of the terminal pins 64 directly touching the surfaces or corners of the HDD is lowered, so that deformation of the terminal pins can be prevented. Further, the first and second guide pins 66*a* and 66*b* of the station connector 48 can prevent any other member from touching the lateral sides of the terminal pins 64, thereby preventing unexpected deformation of the terminal pins more securely.

Furthermore, the first and second engaging holes 58*a* and 58*b* and the first and second guide pins 66*a* and 66*b* can prevent the HDD 10 from being connected inverted to the station connector 48, thereby eliminating the possibility of damage to the plug-in connector 34 and the station connector 48.

Figure 8A:
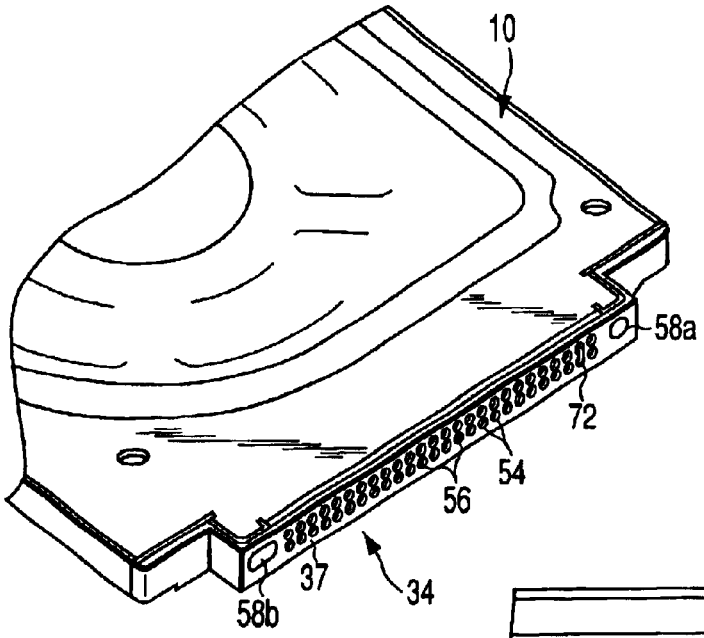
FIG. 8A is a perspective view showing a jumper pin attached to the plug-in connector of the HDD.
Figure 8B:
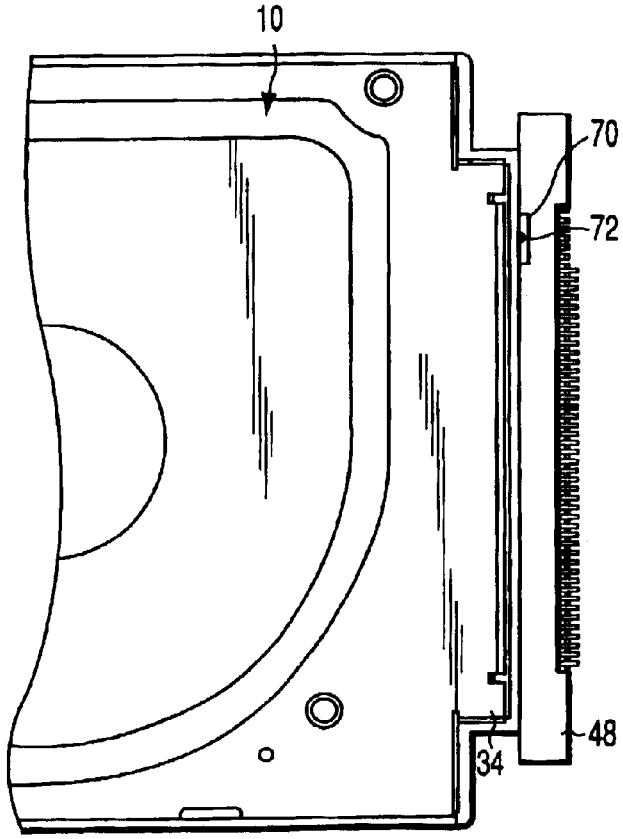
FIG. 8B is a plan view showing the jumper pin and the station connector attached to the plug-in connector of the HDD.

As shown in FIGS. 8A and 8B, the interface setup for the HDD 10 can be changed, for example, by electrically connecting specific connecting terminals 56 by means of a substantially U-shaped jumper pin 72. When the jumper pin 72 is connected to the plug-in connector 34, its end portion slightly projects from the connecting surface 37. Since the recess 70 is formed in the connecting surface 62 of the station connector 48 of the personal computer, as mentioned before, the projecting part of the jumper pin 72 can retreat into the recess 70. Despite the presence of the jumper pin 72 thereon, therefore, the plug-in connector 34 of the HDD 10 can be fully connected to the station connector 48 of the personal computer.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For example, the sectional shapes of the first and second guide pins need not always be circular or elliptical, and may be selected from various other shapes as required. Further, the present invention is not limited to HDDs, and is also applicable to any other card-shaped electronic apparatuses, such as memory cards, modem cards, etc.

What is claimed is:

1. A connector unit comprising:

a first connector including a first connector body having an elongated first connecting surface with a given width, a large number of connecting holes formed in the first connector body to open the first connecting surface, having connecting terminals therein, and arranged in the longitudinal direction of the first connecting surface, and first and second engaging holes formed in the first connector body and opening in the first connecting surface on the opposite end sides of the array of connecting holes, individually; and a second connector connected to the first connector, the second connector including a second connector body having a second connecting surface with a width and a length substantially equal to those of the first connecting surface, a large number of terminal pins fixed to the second connector body, protruding from the second connecting surface, and arranged on the second connecting surface corresponding to the connecting holes of the first connector, and first and second guide protrusions protruding from the second connecting surface, located on the opposite end sides of the array of terminal pins, and configured to be inserted into the first and second engaging holes, respectively, to guide the first and second connectors into connection in cooperation with the first and second engaging holes, the first and second guide protrusions projecting higher than the terminal pins and having different cross sectional shapes, the first engaging hole having a cross sectional shape corresponding to that of the first guide protrusion and being adapted to allow insertion of the first guide protrusion and restrain insertion of the second guide protrusion, the second engaging hole having a cross sectional shape corresponding to that of the second guide protrusion and being adapted to allow insertion of the second guide protrusion and restrain insertion of the first guide protrusion.

2. A connector unit according to claim 1, wherein the first and second guide protrusions are molded integrally with the second connector body.

3. A connector unit according to claim 1, wherein the first connector has a jumper pin connected to the connecting holes, and the second connector has a recess formed in the second connecting surface and capable of receiving the jumper pin attached to the connecting holes of the first connector.

4. An electronic apparatus system comprising:

an electronic apparatus having a first connector, the first connector including a first connector body provided on an end portion of the electronic apparatus and having an elongated first connecting surface with a given width, a large number of connecting holes formed in the first connector body to open the first connecting surface, having connecting terminals therein, and arranged in the longitudinal direction of the first connecting surface, and first and second engaging holes formed in the first connector body and opening in the first connecting surface on the opposite end sides of the array of connecting holes, individually; and a main apparatus having a second connector to which the first connector is connected, the second connector including a second connector body having a second connecting surface with a width and a length substantially equal to those of the first connecting surface, a large number of terminal pins fixed to the second connector body, protruding from the second connecting surface, and arranged on the second connecting surface corresponding to the connecting holes of the first connector, and first and second guide protrusions protruding from the second connecting surface, located on the opposite end sides of the array of terminal pins, and configured to be inserted into the first and second engaging holes, respectively, to guide the first and second connectors into connection in cooperation with the first and second engaging holes, the first and second guide protrusions projecting higher than the terminal pins and having different sectional shapes, the first engaging hole having a cross sectional shape corresponding to that of the first guide protrusion and being adapted to allow insertion of the first guide protrusion and restrain insertion of the second guide protrusion, the second engaging hole having a cross sectional shape corresponding to that of the second guide protrusion and being adapted to allow insertion of the second guide protrusion and restrain insertion of the first guide protrusion.

5. An electronic apparatus system according to claim 4, wherein the first and second guide protrusions are molded integrally with the second connector body.

6. An electronic apparatus system according to claim 4, wherein the electronic apparatus includes: a base on which is mounted a magnetic disc, a drive motor for supporting and rotating the magnetic disc, a magnetic head for writing information to and reading it from the magnetic disc, and a head actuator supporting the magnetic head for movement on the magnetic disc; a printed circuit board on which is mounted the first connector; and a cover overspreading the base and the printed circuit board.

7. An electronic apparatus system according to claim 4, wherein the first connector has a jumper pin connected to the connecting holes, and the second connector has a recess formed in the second connecting surface and capable of receiving the jumper pin attached to the connecting holes of the first connector.

8. An electronic apparatus system comprising:

a card-shaped electronic apparatus having a first connector, the first connector including a first connector body provided on an end portion of the card-shaped electronic apparatus and having an elongated first connecting surface with a width smaller than the thickness of the card-shaped electronic apparatus and a length less than the width of the card-shaped electronic apparatus, a large number of connecting holes formed in the first connector body, opening in the first connecting surface, having connecting terminals therein, and arranged in the longitudinal direction of the first connecting surface, and first and second engaging holes formed in the first connector body and opening in the first connecting surface on the opposite end sides of the array of connecting holes, individually; and a main apparatus having a second connector to which the first connector is connected, the second connector including a second connector body having an elongated second connecting surface with a width less than the thickness of the electronic apparatus and a length less than the width of the electronic apparatus, a large number of terminal pins fixed to the second connector body, protruding from the second connecting surface, and arranged on the second connecting surface corresponding to the connecting holes of the first connector, and first and second guide protruding from the second connecting surface, located on the opposite end sides of the array of terminal pins, and configured to be inserted into the first and second engaging holes, respectively, to guide the first and second connectors in connection into cooperation with the first and second engaging holes, the first and second guide protrusions projecting higher than the terminal pins and having different sectional shapes, the first engaging hole having a cross sectional shape corresponding to that of the first guide protrusion and being adapted to allow insertion of the first guide protrusion and restrain insertion of the second guide protrusion, the second engaging hole having a cross sectional shape corresponding to that of the second guide protrusion and being adapted to allow insertion of the second guide protrusion and restrain insertion of the first guide protrusion.

9. An electronic apparatus system according to claim 8, wherein the first and second guide protrusions are molded integrally with the second connector body.

10. An electronic apparatus system according to claim 8, wherein the electronic apparatus includes:

a base on which is mounted a magnetic disc, a drive motor for supporting and rotating the magnetic disc, a magnetic head for writing information to and reading it from the magnetic disc, and a head actuator supporting the magnetic head for movement on the magnetic disc; a printed circuit board on which is mounted the first connector; and a cover overspreading the base and the printed circuit board.

11. An electronic apparatus system according to claim 8, wherein the first connector has a jumper pin connected to the connecting holes, and the second connector has a recess formed in the second connecting surface and capable of receiving the jumper pin attached to the connecting holes of the first connector.

12. An electronic apparatus connectable to a main apparatus, comprising:

a body including a base on which is mounted a disc, a drive motor for supporting and rotating the disc, a head for writing information to and reading it from the disc, and a head actuator supporting the head for movement on the disc;

a plug-in connector provided on an end portion of the body and connected to a station connector of the main apparatus, the plug-in connector including a connector body having an elongated connecting surface with a given width, a large number of connecting holes formed in the connector body so as to be arranged in the longitudinal direction of the connecting surface, having connecting terminals therein, and adapted to be penetrated individually by terminal pins, and first and second engaging holes formed in the connector body, opening in the connecting surface on the opposite sides of the array of connecting holes, individually, and configured to be penetrated individually by guide protrusions of the station connector, the first and second engaging holes having different cross sectional shapes;

a printed circuit board on which is mounted the first connector; and a cover overspreading the base and the printed circuit board.

13. A main apparatus comprising:

a mount portion in which an electronic apparatus having a plug-in connector is set; and a station connector located adjacent to the mount portion and connected with the plug-in connector, the station connector including a connector body having an elongated connecting surface with a given width, a large number of terminal pins fixed to the connector body, protruding from the connecting surface, and arranged on the connecting surface corresponding to connecting holes of the plug-in connector, and first and second guide protrusions protruding from the connecting surface, located on the opposite end sides of the array of the terminal pins, and configured to be inserted individually into engaging holes of the plug-in connector to guide the plug-in connector and the station connector into connection, the first and second guide protrusions projecting higher than the terminal pins and having different cross sectional shapes.

14. A main apparatus according to claim 13, wherein the station connector has a recess formed in the connecting surface and capable of receiving a jumper pin attached to the plug-in connector.

* * * * *